US006370706B1

(12) United States Patent
Walraven

(10) Patent No.: US 6,370,706 B1
(45) Date of Patent: Apr. 16, 2002

(54) PORTABLE SANITATION UNIT

(75) Inventor: Hans Walraven, Lake Havasu City, AZ (US)

(73) Assignee: Atlas Portable Sanitation Industries, Inc., Lake Havasu City, AZ (US)

( * ) Notice: Subject to any disclaimer, the term of this patent is extended or adjusted under 35 U.S.C. 154(b) by 0 days.

(21) Appl. No.: 09/416,884

(22) Filed: Oct. 13, 1999

(51) Int. Cl.[7] ..... E03D 1/00
(52) U.S. Cl. ..... 4/321; 4/476
(58) Field of Search ..... 4/321, 449, 459, 4/476, 664

(56) References Cited

U.S. PATENT DOCUMENTS 4,305,164 A * 12/1981 Sargent et al. ..... 4/459 X
4,493,118 A * 1/1985 Braxton ..... 4/459 X
5,398,465 A * 3/1995 Tagg ..... 4/449 X

OTHER PUBLICATIONS

Synergy brochure for High Tech 1, 10 pgs., No Date Given.
Atlas Athena brochure, 2 parts, No Date Given.

* cited by examiner

*Primary Examiner*—Robert M. Fetsuga
(74) *Attorney, Agent, or Firm*—Young & Thompson

(57) ABSTRACT

A portable sanitation unit includes a base, a sanitation unit housing having a door and provided with a floor and a sanitation unit pan. A waste tank is situated on the base. Apart from the waste tank, a flushing water tank is also fitted below the waste tank. The walls of the sanitation unit housing consist of panels situated at a distance from each other, the outside panels being connected to each other and resting against each other when the inside panels are fitted at an angle. The ends of the walls are provided with a construction for connecting them together, the construction including mirror-symmetrical lips provided with receiving parts through which a pin is guided.

9 Claims, 2 Drawing Sheets

PORTABLE SANITATION UNIT

The invention relates to a portable sanitation unit, comprising a base, a sanitation unit housing having a door and provided with a floor and a sanitation unit pan, and below the latter a waste tank resting upon the base.

BACKGROUND OF THE PRIOR ART

Portable sanitation units are generally known. They are used on building sites, at events such as fetes and at other places where sanitation units are needed temporarily. In the case of these sanitation units no drain pipe is generally present. In the case of some sanitation units a facility for flushing water is present, consisting of a flushing water tank provided outside the sanitation unit, the flushing water tank being connected by means of a pipe to the sanitation unit housing, in which a pump is fitted for pumping the water to the pan or to a washbasin.

If such portable sanitation units remain standing at a location for a fairly long period, a maintenance team empties the waste tank regularly and cleans the sanitation unit.

The circumstances in which such portable sanitation units are used are relatively servere. In general, these are sanitation units which are used by the public only once or a few times, and the sanitation units are situated in isolated places, which makes them particularly susceptible to vandalism.

SUMMARY OF THE INVENTION

It is an object of the present invention to provide a portable sanitation unit which is more vandal-resistant and is easier to use and to set up, and which has a flushing water facility present in the sanitation unit.

It is a further object of the present invention to increase the stability of a portable sanitation unit, in particular its stability in windy conditions.

It is a further object of the present invention to provide a portable sanitation unit in which the walls of the sanitation unit housing can be manufactured in a particularly simple way.

It is a further object of the present invention to provide a sanitation unit housing in which adjacent walls can be connected to each other in a particularly simple way.

According to the invention, provision is made for a portable sanitation unit, comprising a sanitation unit housing having a door and provided with a floor and a sanitation unit pan, and a waste tank resting upon the floor, water flushing means being present for said pan, which water flushing means comprise a storage tank for flushing water, and said flushing water tank being fitted at least partially below said floor or said floor level of said sanitation unit housing.

According to another aspect of the invention, provision is made for a portable sanitation unit, comprising a sanitation unit housing having a door and provided with a floor with toilet pan placed thereon, and placed below the latter a waste tank which rests upon the floor, said sanitation unit housing comprising walls wherein at least two adjacent walls positioned at an angle are integral, and said walls each comprising spaced inside and outside panels, the outside panels of adjacent walls being connected by means of a connecting piece, and the inside panels being arranged at a distance from each other if said walls are situated in the same plane.

According to a further aspect of the invention, provision is made for a sanitation unit housing, the sanitation unit housing comprising at least first and second walls connected to each other, said connection comprising lips provided near the connection end of each wall, and said lips interacting with each other in such way that in the connected state a substantially smooth continuous connection is produced.

DETAILED DESCRIPTION OF THE INVENTION

The invention will be explained further below with reference to an exemplary embodiment shown in the drawing, in which.

Figure 1:
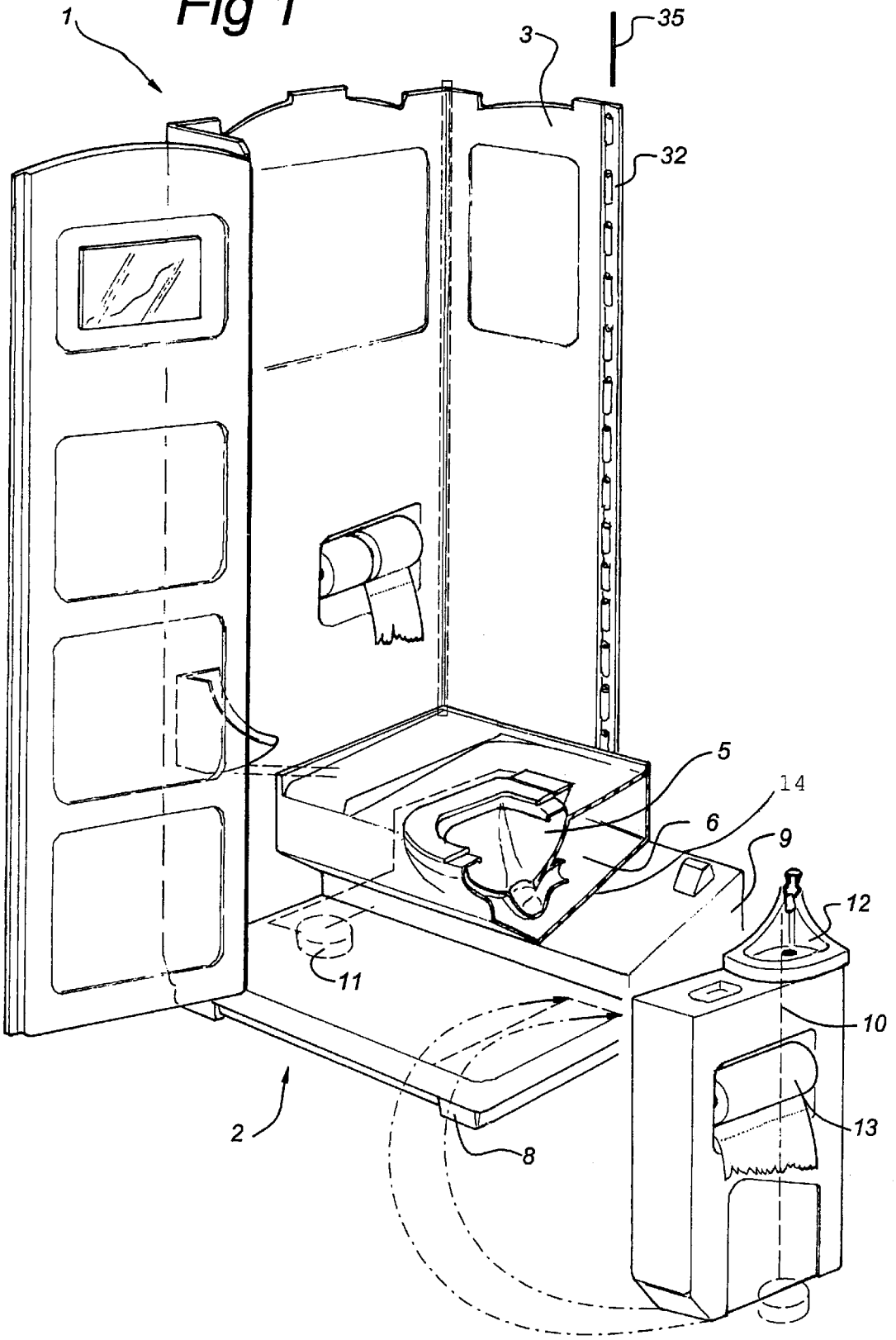
FIG. 1 shows in perspective and partially cut away a sanitation unit according to a preferred embodiment of the invention.

In FIG. 1 reference numeral 1 shows diagrammatically a portable sanitation unit according to the invention. It will be understood that the exterior thereof is dependent upon the specific embodiment and can be modified in many ways. The sanitation unit 1 is composed of a sanitation unit floor and sanitation unit subframe 2 placed on a desired surface. Reference numeral 3 indicates a sanitation unit housing with door 15. A waste tank 6 is situated on the floor 2. Sanitation unit pan 5 is integral with the construction. The floor 2 is provided with feet 8. Waste tank 6 according to the invention is combined with a flushing water tank 9. Flushing water tank 9 is provided with a flushing line 10, to which a pump 11, fitted in the floor, is connected. A washbasin 12 is also formed integrally in the opposite wall part, in which a paper dispenser is likewise provided. Further paper dispensers may be present.

According to the present invention, the flushing water tank 9 is fitted below the waste tank 6. When the sanitation unit is put in position, the waste tank 6 will generally be empty and the flushing water tank 9 full. Since the latter is situated very low down in the base, its weight will ensure good stability of the sanitation unit housing, thus preventing it from being blown over or pushed over. Moreover, since the flushing water tank is situated inside the sanitation unit housing, and no longer outside it, the flushing water tank is not exposed to influences from outside such as vandalism and to a lesser extent the effect of frost. Furthermore, flushing water tank 9 is present immediately at the time of placing of the sanitation unit, and it is not necessary to provide for separate connections or separate operations.

During use of the sanitation unit according to the invention the waste tank 6 will be filled when the flushing water tank 9 empties, with the result that the stability is retained.

By designing the flushing water tank in an efficient manner, it is possible, with the same size of sanitation unit, to keep the volume of the waste tank virtually unchanged.

According to the invention, the flushing water tank and waste tank are formed as two parts and subsequently placed one on top of the other, for example using locating lugs. The method by which such a tank assembly can be manufactured is so-called rotamoulding.

Figure 2:
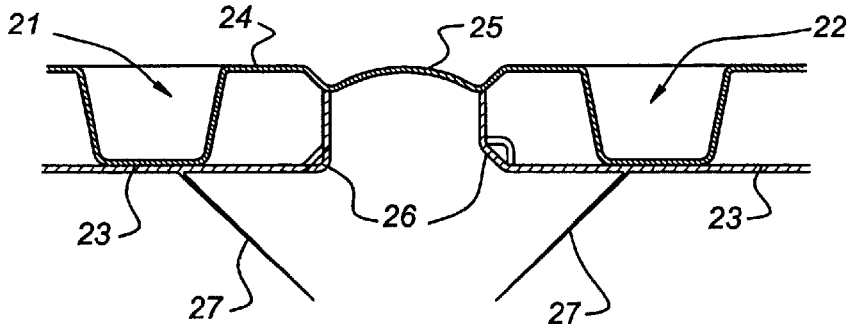
FIG. 2 shows in top view in cross section a wall assembly according to the invention, in the unassembled state.

A further detail of the invention is illustrated in FIG. 2, from which it can be seen that the walls are integral. Wall parts 21 and 22 are manufactured in one piece by blow moulding. An extremely lightweight, sturdy construction can be obtained by this method. Each wall part consists of an inside wall panel 23 and an outside wall panel 24.

Figure 3:
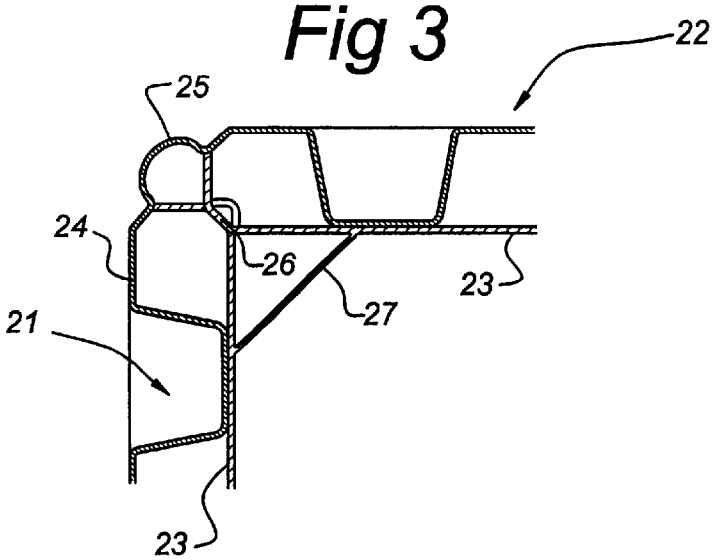
FIG. 3 shows the wall assembly according to FIG. 2 in the assembled state.

Adjacent outside wall panels are connected by means of connection 25. The inside wall panels 23 are provided with a bevel 26 and wings 27 near the ends. The positioning of the walls 21 and 22 in the position for use is shown in FIG. 3. It can be seen that a snug-fitting unit is obtained, with perfect sealing being provided on the outside by means of the connecting part 25. From the inside, the overlapping wings 27 produce an optimum rounded corner which is easy to clean with, for example, a high-pressure jet.

Figure 4:
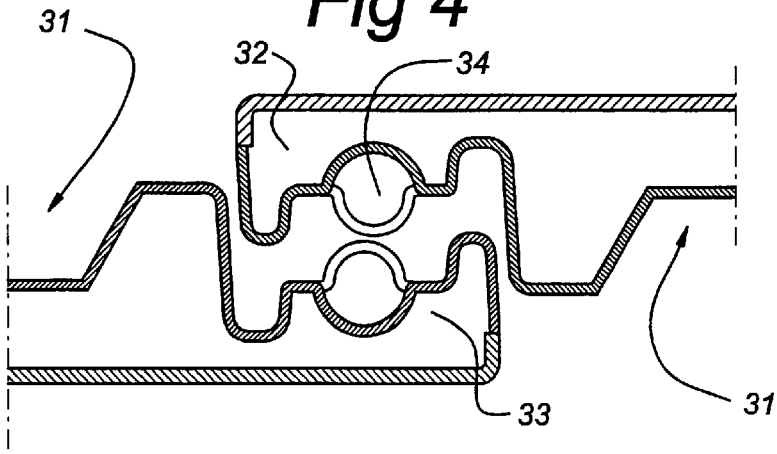
FIG. 4 shows in top view in cross section the connection of two wall ends.

The connection of two end parts of the walls is shown in FIG. 4. These end parts are always indicated by 31 and comprise lips or tongues 32, 33. These are each provided with a receiving part 34. When the end parts are placed against each other, a continuous channel into which a pin 35 (see FIG. 1) can be inserted is produced.

In this way, when wall parts are connected to each other, a large continuous exterior which is extremely resistant to damage is obtained.

The wall assembly described above, consisting of wall parts 21 and 22, can be manufactured in any way known in the prior art. Apart from the blow moulding described above, thermoforming is possible.

Although the invention is described above with reference to a preferred embodiment, anyone skilled in the art will understand that numerous modifications may be made without going beyond the scope of the present invention as described in the appended claims.

What is claimed is:

1. A portable sanitation unit, comprising:

a sanitation unit housing with a door and a floor;

a waste tank resting on said floor;

a sanitation unit pan operatively connected to said waste tank;

a water flushing means operatively connected to said sanitation unit pan and including a water flushing storage tank located adjacent said waste tank for flushing water, the water flushing storage tank being supported on said floor or integral with said floor; and said sanitation unit housing comprising walls wherein at least two adjacent walls positioned at an angle are integral, wherein, each of said at least two adjacent walls comprise spaced inside and outside panels, the outside panels of adjacent walls being connected by a connecting piece, and the inside panels being disposed at a distance from each other where said walls are situated in the same plane.

2. The portable sanitation unit of claim 1, wherein said waste tank is arranged on said water flushing storage tank.

3. The portable sanitation unit of claim 1, wherein said inside panels comprise an end boundary extending substantially perpendicular thereto.

4. A portable sanitation unit, comprising:

a sanitation unit housing with a door and a floor;

a waste tank resting on said floor;

a sanitation unit pan operatively connected to said waste tank;

a water flushing means operatively connected to said sanitation unit pan and including a water flushing storage tank located adjacent said waste tank for flushing water, the water flushing storage tank being supported on said floor or integral with said floor, wherein the sanitation unit housing comprises at a first wall connected to a second wall at a connection, the connection comprising first lips and second lips disposed near a connection end of each of the first and second walls respectively, said first and second lips interacting with each other to provide a substantially smooth continuous connection at said connection, and said first and second lips comprise receiving parts arranged to produce, at said connection, a substantially continuous hole for the insertion of a connecting part.

5. A portable sanitation unit, comprising:

a sanitation unit housing with a door and a floor;

a waste tank resting on said floor; and a sanitation unit pan operatively connected to said waste tank, said sanitation unit housing comprising walls wherein at least two adjacent walls are integral and positioned at an angle, said at least two adjacent walls each comprising spaced inside and outside panels, the outside panels of adjacent walls being connected by a connecting piece, and the inside panels being disposed at a distance from each other if said two adjacent walls are situated in the same plane.

6. The portable sanitation unit of claim 5, wherein said inside panels comprise an end boundary extending substantially perpendicular thereto.

7. The portable sanitation unit of claim 6, wherein said at least two adjacent walls are connected together at a connection, said connection comprising lips disposed near a connection end of each of said adjacent walls, said lips interacting to produce a substantially smooth continuous connection.

8. The portable sanitation unit of claim 5, wherein said lips of said two adjacent walls comprise receiving parts disposed to produce a substantially continuous hole for insertion of a connecting part.

9. A portable sanitation unit, comprising:

a sanitation unit housing with a door and a floor;

a waste tank resting on said floor; and a sanitation unit pan operatively connected to said waste tank, said sanitation unit housing comprising at least first and second walls connected to each other at a connection, said connection comprising lips disposed near a connection end of each of said first and second walls, said lips interacting with each other to provide a substantially smooth continuous connection, wherein said lips are provided with receiving parts disposed to provide in the connected state a substantially continuous hole for insertion of a connecting part.

* * * * *